United States Patent [19]

Gibson

[11] 4,089,998

[45] May 16, 1978

[54] METHOD OF POWDER COATING THE INTERIOR OF TUBULAR GOODS

[76] Inventor: Jack E. Gibson, 3807 Melody La., Odessa, Tex. 79762

[21] Appl. No.: 704,965

[22] Filed: Jul. 13, 1976

[51] Int. Cl.[2] ..... B05D 7/22; B05D 3/02

[52] U.S. Cl. ..... 427/182; 118/317; 118/318; 118/DIG. 10; 427/181; 427/183; 427/195; 427/232; 427/238; 427/239

[58] Field of Search ..... 427/181, 182, 183, 185, 427/195, 232, 233, 234, 235, 236, 238, 239; 118/DIG. 10, 317, 318

[56] References Cited

U.S. PATENT DOCUMENTS

| | | | |
|---|---|---|---|
| 1,716,384 | 6/1929 | Pettee | 427/181 |
| 1,791,624 | 2/1931 | Jessup | 427/181 |
| 1,997,761 | 4/1935 | Bailey et al. | 118/DIG. 10 |
| 2,758,546 | 8/1956 | Gillette | 418/97 X |
| 2,919,160 | 12/1959 | Blackburn | 302/57 |
| 3,207,618 | 9/1965 | De Hart | 427/183 X |
| 3,208,869 | 9/1965 | Starr et al. | 427/183 X |
| 3,532,531 | 10/1970 | Stallard | 427/183 |
| 3,946,125 | 3/1976 | Scheiber | 427/181 X |
| 3,974,306 | 8/1976 | Inamura et al. | 427/181 X |
| 3,982,050 | 9/1976 | Kato et al. | 427/181 |

*Primary Examiner*—Ronald H. Smith
*Assistant Examiner*—Shrive P. Beck
*Attorney, Agent, or Firm*—Marcus L. Bates

[57] ABSTRACT

The interior of a pipe is coated with a uniform thickness of plastic. A fluidized bed of heat-meltable plastic material in particular form is connected to the inlet end of the pipe, while the opposed end of the pipe is made attachable to a source of reduced pressure. A source of compressible fluid is also connected to the inlet end of the pipe. The pipe is preheated and then rotated axially while the compressible fluid flows therethrough. The compressible fluid flowing to the inlet is suddenly terminated while a flow from the fluidized bed is immediately established so that the vacuum at the outlet end of the pipe causes uninterrupted mass flow and pulls a finite pocket of the finely divided plastic into the pipe. The flow of particular plastic material is terminated, while the flow of compressed gas is immediately reestablished, thereby pushing the pocket of plastic material into and through the pipe.

13 Claims, 8 Drawing Figures

S1
S2
S3
S4
L1
L2
TD1
TD2
TD3
TD4
N.O.
N.O.
N.O.
N.O.
19
20
22
24
28
30
38
40
42
44
46
47
48
50
51
58
59
60
61
62
64
65
66
67
68
69
70
71
72
73
74
76
78
80
82
84

METHOD OF POWDER COATING THE INTERIOR OF TUBULAR GOODS

BACKGROUND OF THE INVENTION

It is known to coat the interior of metal pipes by forcing entrained particles of plastic to flow through a preheated, rotating pipe. DeHart, U.S. Pat. No. 3,207,618, discloses apparatus and method by which a fluidized bed of plastic particles are passed into a pipe in order that the particles may adhere to the interior sidewall thereof and bond to one another and to the surface of the pipe, to provide a continuous coating. The Dehart disclosure suggests duplicate equipment arranged at opposed ends of the pipe so that the entrained plastic can be flowed through the pipe in a first direction and thereafter flowed through the pipe in a reverse direction, thereby providing a more uniform coating on the interior of the pipe. Moreover, DeHart employs a separator and a vacuum combination at the outflow end of the pipe.

Stallard, U.S. Pat. No. 3,532,531, is similar to the DeHart disclosure, and additionally supercools the plastic particles prior to forcing the particular plastic to flow into the rotating pipe.

Blackburn, U.S. Pat. No. 2,919,160, discloses apparatus for dispending powdery materials wherein a fluidized bed of pulverulent material is transferred to a mold.

Condo et al, U.S. Pat. No. 3,814,616, places a pipe to be coated within an oven and coates the interior thereof by sucking air into one end while feeding negatively charged, dry particles of a coating composition into the other end.

Randell, U.S. Pat. No. 2,758,546; Dalley et al, U.S. Pat. No. 1,997,761; DeHart, U.S. Pat. No. 3,207,618; Star et al, U.S. Pat. No. 3,208,869; Church, U.S. Pat. No. 3,108,022; and Weidenhammer et al, U.S. Pat. No. 3,260,611, are further examples which set forth known prior art expedients which involve the handling of particulated plastic and the deposition of the plastic onto a wall surface in order to form a coating. Reference is made to the above issued patents, and to the art cited therein, for further background of this invention.

In actual practice, so far as Applicant can determine, these and other presently known processes for coating the interior of metal pipe fail to provide a coating of substantial uniform thickness. It is for this reason that some processes require that the pipe be twice treated by flowing the plastic material in one direction through the pipe, and thereafter flowing the material through the pipe in an opposite direction, thereby laying down two separate coatings in order that the thickness of the coating will not unduly diminish from one end to the other of the pipe. These and some other known processes require reprocessing as much as 30 percent of the completed pipes because the coating is unsatisfactory.

After a pipe has been coated and tested, should the coating fail to measure up to acceptable standards, the coating must be removed and the pipe returned for reprocessing. Usually the coating is burned out or oxidized by utilizing a flame on the interior thereof. The reprocessing of unsuitable pipe is expensive.

It would therefore be desirable to be able to apply a protective plastic coating to the interior of the pipe in such a manner that the coating is uniform from one end of the pipe to the other and about the entire inside peripheral surface of the pipe, while at the same time, the process of coating is carried out in such a manner that very few of the pipes must be reprocessed.

SUMMARY OF THE INVENTION

Method and apparatus for coating the interior of an elongated, hollow member by flowing particulated, synthetic, polymeric material from a fluidized bed into the pipe. The member to be coated is heated to a temperature above the softening temperature of the polymeric material and thereafter rotated about the longitudinal axis thereof at an angular velocity which causes any polymeric material adhering to the interior surface to form a uniform coating about the entire inside peripheral wall surface thereof.

In the preferred embodiment of the invention, the inlet end of a pipe is connected in parallel relationship to a fluidized bed of the polymeric material and to a source of compressed gas such that the inlet end of the pipe can be immediately and selectively connected to either the fluidized bed or to the compressed gas source. The outlet end of the pipe is removably connected to a suction means.

The pipe is cleaned and preheated, and then rotated at an angular velocity sufficient to cause a particle of melted plastic to flow in all directions to thereby coat the pipe interior.

Flow is first established by connecting the inlet end of the pipe to the compressed gas, while the outlet end is connected to the suction. The compressed gas source is terminated while the flow from the fluidized bed is instantaneously initiated so that the mass flow through the pipe is augmented by the suction for a timed interval. This expedient injects a pocket of air-entrained particles of plastic into the pipe. The flow from the fluidized bed is terminated and the flow from the compressed gas immediately re-established to thereby push the pocket of plastic material through the pipe.

Means are provided by which the suction is removed from the outlet end of the pipe before the pocket of plastic material emerges therefrom.

The pipe continues spinning for a sufficient length of time to spread the melted, adhering particles of plastic into a continuous film.

Accordingly, a primary object of this invention is the provision of both method and apparatus for applying a continuous coating of plastic to the interior of a pipe.

Another object of the invention is to provide a pipe coating process wherein a flow of compressible gases through the pipe is interrupted by a flow of particulated plastic material for a finite length of time, after which the flow of compressible gases is immediately resumed, thereby causing a pocket of gas-entrained particles to flow down through the pipe as the particles adhere to the interior wall where they are melted, and subsequent centrifugal force forms a continuous film about the entire inner peripheral wall surface of the pipe.

A further object of this invention is to disclose and provide a pipe coating process wherein a preheated spinning pipe has an outlet end thereof connected to a suction means so that compressible gas is forced to flow through the pipe. At the same time, compressed gas is forced to flow into the inlet end of the pipe. As the mass flow proceeds through the pipe, a flow of air-entrained plastic particles is substituted therefor; and thereafter, the flow of air-entrained plastic particles is terminated, and immediately thereafter the flow of compressed gas resumed. The suction is removed from the outlet end of the pipe before the pocket of plastic particles emerges therefrom.

A still further object of this invention is to provide a method for coating hollow, elongated members, comprising producing a continuous flow of compressible fluid through the pipe, which includes a pocket of gas-entrained plastic particles therein, and applying a suction at the outlet end of the pipe during the time interval that the plastic is being injected thereinto, and resuming the flow of compressed gases after removing the suction before the plastic particles emerge therefrom.

Another and still further object of this invention is the provision of apparatus which includes electrical circuitry by which a rotating heated pipe has a mass flow of compressed gases established therethrough, and a pocket of gas-entrained plastic particles is caused to flow in series relationship with the compressed gas flow to thereby enable the particles to contact and adhere to the sidewall of the pipe.

These and other objects and advantages of the invention will become readily apparent to those skilled in the art upon reading the following detailed description and claims and by referring to the accompanying drawings.

The above objects are attained in accordance with the present invention by the provision of method and apparatus fabricated in a manner substantially as described in the above abstract and summary.

DETAILED DESCRIPTION OF THE PREFERRED EMBODIMENT

Throughout the various figures of the drawings, wherever it is possible or logical to do so, like numerals generally refer to like or similar parts.

Figure 1:
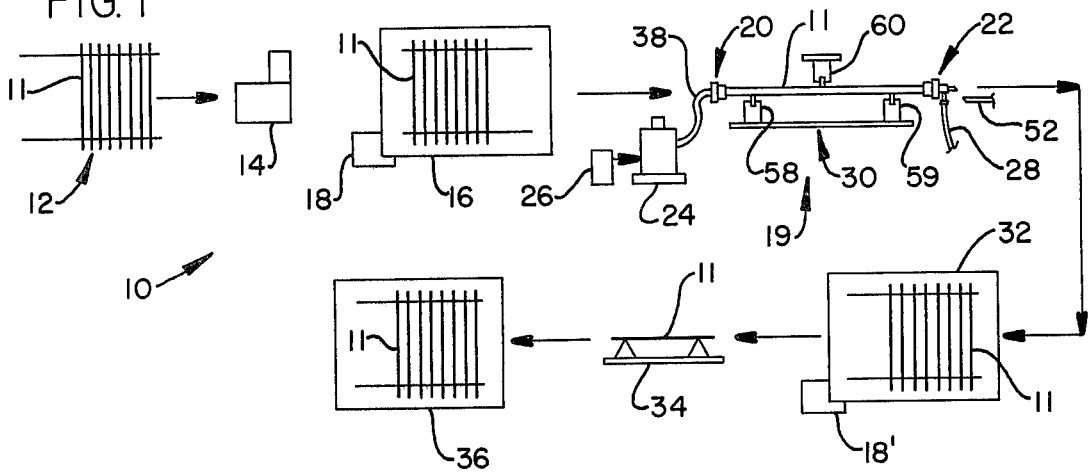
FIG. 1 is a part diagrammatical, part schematical illustration of a process for coating elongated tubular members in accordance with the present invention.

FIG. 1 diagrammatically discloses a process 10 for coating the interior of an elongated member, such as a pipe, with a continuous uniform coating of plastic. The process commences with individual joints of used or new pipe 11 which is stored in a conventional manner, such as a pipe rack 12, for example, so that the pipe can be continuously fed in series relationship into a cleaning device 14. The cleaning device generally is a sandblasting apparatus; or alternatively, a shotpeening device wherein the interior of the pipe is subjected to a cleaning action according to prior art expedients.

The pipe continues into an oven 16 where the temperature thereof is elevated to approximately 410° F. by any conventional heating means 18.

The hot pipe is next conveyed to a coating station 19. A removably swivel coupling 20 and 22, respectively, are attached to the inlet and outlet ends, respectively, of the pipe. Apparatus 24 contains a fluidized bed of plastic particles and preferably is connected by a flexible conduit to the coupling 20. A source of compressed gas 26, preferably air, is connected to the fluidized bed apparatus.

Suction means 28 is connected to the connector 22 so that a suction can be pulled on the outlet end of the pipe. Apparatus 30 supports the pipe in a rotatable manner so that the pipe can be rotated about its longitudinal axis at a rotational velocity which produces sufficient centrifugal force to cause the heated plastic particles to flow into a continuous uniform coating.

The threaded ends of the pipe is sometimes coated manually and the pipe thereafter conveyed to a curing oven 32 where the pipe is baked until the coating is cured. This step of the process is sometimes eliminated where the characteristics of the coating do not demand baking.

The pipe is next conveyed to a rack means 34 where the interior of the pipe is inspected by utilizing equipment known to those skilled in the art. The finished product is stored at 36 until it is needed.

Figure 2:
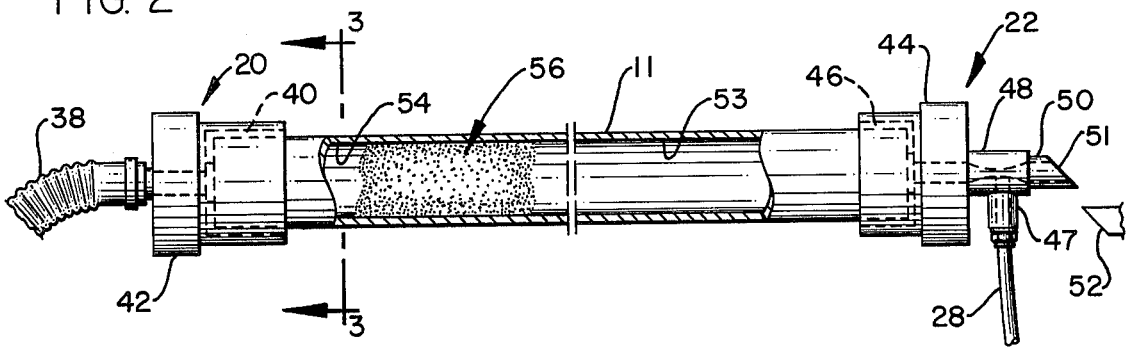
FIG. 2 is an enlarged, side elevational view of part of the apparatus disclosed in FIG. 1, with some parts thereof being cut away and some of the remaining parts being shown in cross-section.
Figure 3:
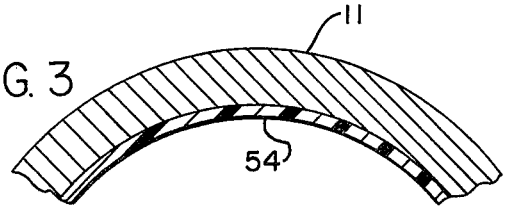
FIG. 3 is a fragmented, enlarged, part cross-sectional view taken along line 3—3 of FIG. 2.

Looking now to the details of FIGS. 2 and 3, in conjunction with other figures of the drawings, it will be noted that a flexible hose 38 is affixed to the connector 20. The connector has a marginal end portion 40 rotatably and sealingly connected to a stationary member 42. A marginal inlet end of the pipe is telescopingly received in sealed relationship within the rotatable portion of the connector.

The outlet connector 22 includes a stationary member 44 which is sealingly connected to a rotatable member 46. Flexible hose 28 supplies high pressure air at 47 so that a venturi device 48 can produce a suction on the outlet end 51 of the pipe. Tube 50 includes the outlet 51 through which products can flow through the pipe 11 and outwardly away therefrom and towards a chute 52. The marginal interior surface at 53 of the pipe 11 disclosed in FIG. 2 has been cleaned, but is devoid of plastic coating. The surface at the marginal inlet end 54 of the pipe has been coated as a result of a pocket 56 of air-entrained plastic particles passing therethrough.

As best seen in FIG. 3, deposition of plastic particles from the pocket 56 adheres to the heated wall surface of the pipe so that a plastic film 54 is formed as the pipe rotates at a velocity dependent upon its size, as for example, 80 to 100 RPM for a 2⅜ inch diameter pipe.

Figure 4:
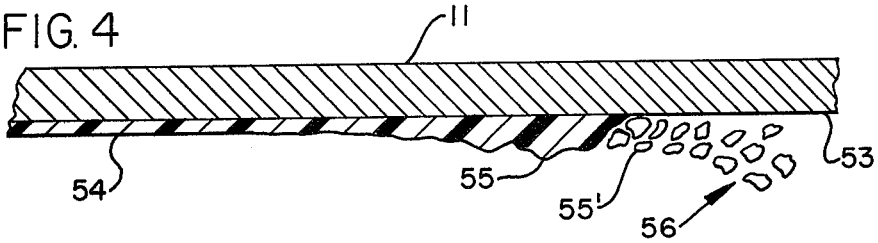
FIG. 4 is an enlarged, fragmented, part diagrammatical, part schematical, longitudinal, part cross-sectional detailed view of part of the apparatus disclosed in FIGS. 2 and 3.

In FIG. 4, the rotating preheated pipe has the before mentioned inside peripheral surface 53 initially coming into contact with the pocket of plastic particles 56. The plastic particles commence touching the pipe wall at 55', and at 55 the particles have commenced melting and adhering to one another. The centrifugal action of the pipe forms the individual particles of plastic into a continuous, uniform film at 54.

Figures 5, 7, 8:
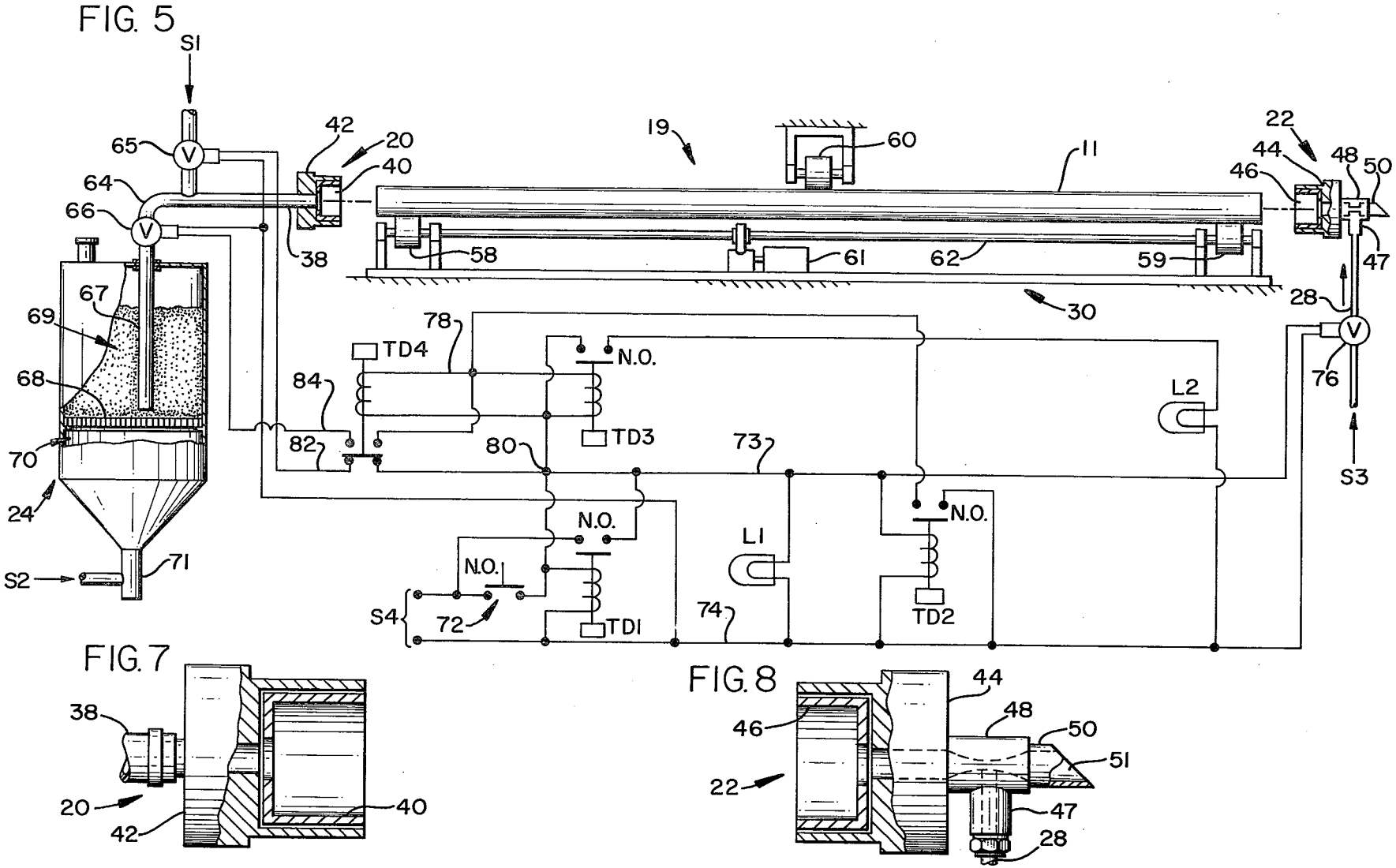
FIG. 5 is an enlarged, detailed, part cross-sectional view of part of the apparatus for use in conjunction with the process disclosed in FIG. 1.
FIGS. 7 and 8 are enlarged, detailed, part cross-sectional views of part of the apparatus disclosed in FIGS. 5 and 6.

The specific embodiment of FIG. 5 illustrates the details of the coating station previously seen at 19 in FIG. 1. The apparatus of FIG. 5 includes roller devices 58, 59, and 60 which are spaced from one another and arranged according to prior art expedients such that a prime mover 61 drives a shaft 62 to thereby spin the pipe at an appropriate rotational velocity. The marginal ends of the pipe are rotatably and sealingly captured by the connector devices 20 and 22 so that fluid flow can be sealingly established from flow conduit 64, through the connector device, through the pipe, through the scavenging or eductor apparatus 22, where the flow products emerge through the outlet tube 50.

Solenoid actuated, normally closed valve 66 controls the flow from standpipe 67 into conduit 64. Fluidized plastic container 24 contains a bed 69 of fluidized plastic, preferably in the form of a polymeric hydrocarbon in particular form. A previous baffle 68, such as a porous, synthetic grindstone or a thick sheet of porous beaverboard, separates chamber 70 from chamber 69. Inlet 71 is connected to a regulated source of air pressure S2 so that flow into plenum chamber 70 and across member 68 establishes the fluidized bed 69.

Normally open switch 72 is moved to the closed position in order to actuate time delay holding relay TD1. When the coil of TD1 is actuated, the normally open contacts thereof close for a predetermined time interval, as for example, 7 seconds. This action connects a source of electrical current S4 across conductors 73 and 74, thereby energizing lamp L1, the coil of TD2, and additionally moves the solenoid actuated valve 76 from the normally closed into the open position.

This action simultaneously illuminates light L1 and moves the armature of TD2 such that the normally open switch associated therewith will close after a preset time interval. Opening of valve 76 causes a source of compressed air S3 to flow into the eductor 47, thereby producing a low pressure area at the outlet end of the pipe 11.

This action also provides blow air because the normally closed solenoid actuated valve 65 is moved to the open position, while the normally closed valve 66 remains in the closed position.

The switch at TD2 closes after approximately 1 second of operation and remains closed so long as current is imposed on the solenoid thereof. Closure of the normally open TD2 switch contacts completes the circuitry between conductors 74 and 78, thereby energizing the parallel connected solenoids of TD3 and TD4.

Energization of TD4 immediately moves the contacts thereof to the alternate position, thereby moving the normally open contacts into the closed position while the normally closed contacts are opened. Accordingly, the circuitry at 82 is broken and solenoid 65 moves the flow air valve to its normally closed position, thereby discontinuing flow of compressed gas from S1 into 20. At the same time the normally open contacts of TD4 are moved to the closed position, thereby completing the circuitry required to energize the normally closed paint solenoid valve 66. Time delay relay 4 will remain in this alternate position for approximately 1 second, depending upon the length and diameter of the pipe undergoing treatment; and therefore for the time interval selected for the desired charge size from 69.

The above action causes the particles of plastic to flow into standpipe 67, through the coupling 20, into the pipe, and towards the outlet end of the pipe. Member 22 effects a suction at the outlet end of the pipe during this operation.

It is desirable to remove the coupling 22 from the outlet end of the pipe after valve 66 closes and valve 65 reopens. Accordingly, TD3 is set to time out after an interval of time which achieves this expedient. Therefore, TD3 is generally set for a time interval of approximately 3/10 second greater than the time interval required of TD4.

Accordingly, TD4 times out, closing paint valve 66 and opening blow air valve 65 to thereby push the pocket of plastic into the pipe. TD3 times out approximately 3/10 second following the time interval of TD4, extinguishing L2 and indicating that the suction or jet member 22 should be removed from the end of the pipe.

After member 22 has been removed and the pocket 56 emerges from the outlet, the pipe continues spinning until TD1 times out, thereby completing the work at station 19.

FIGS. 7 and 8 illustrate the details of one configuration which the inlet and outlet couplings 20 and 22 can take on. As seen in FIG. 8, the eductor which produces a suction at the outlet end of the pipe is comprised of the before mentioned stationary and rotatable members. Any number of different expedients can be employed to attain this relative rotational motion. The jet air supply at 47 must be of sufficient velocity and volume respective to the illustrated venturi to produce a sufficiently low pressure at the outlet end of the pipe to produce a flow from the fluidized bed.

The construction of the coupling 20 is similar in some respects to 22, and can take on a number of different forms so long as relative rotational sealed motion is effected between the rotatable and stationary parts of the coupling member.

Figure 6:
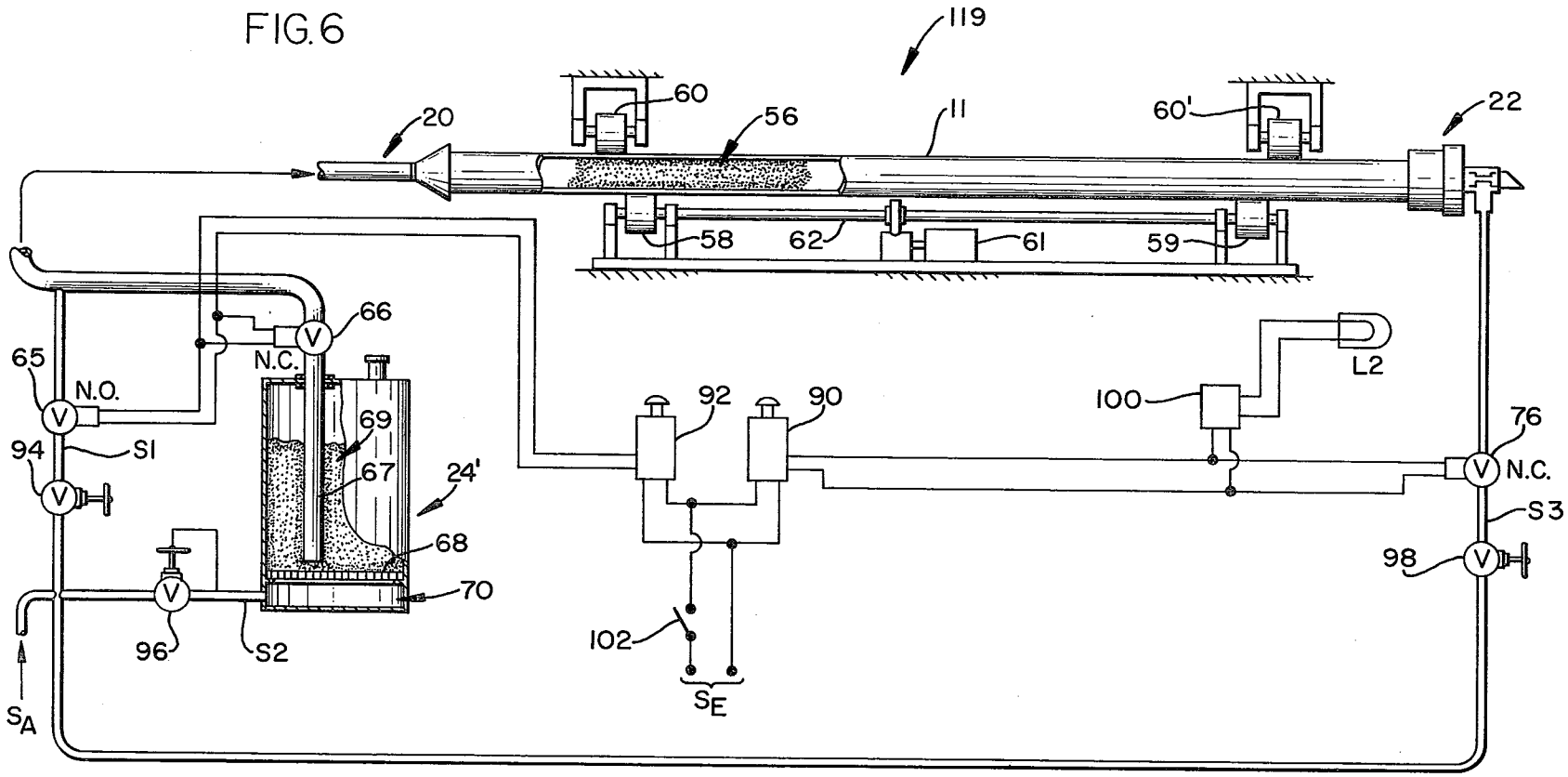
FIG. 6 is similar to FIG. 5 and shows an alternate embodiment thereof.

FIG. 6 exemplifies a simplified embodiment of the control system of the instant process, wherein two manually operated time delay mechanisms 90 and 92 are placed in "side-by-side" relationship and connected to a source of electrical current SE. Regulator 94 provides a regulated air source for the normally open valve 65. Regulator 96 maintains an optimum pressure within chamber 70 so that the pervious baffle 68 admits sufficient flow into the container 24' to effect a rolling or fluidized bed of plastic particles 69. Regulator 98 provides a regulated air source for the normally open solenoid actuated valve 76 to thereby produce the proper suction at the outlet end of the pipe. Time delay means 100 is set to cause light L2 to be extinguished after a preset time.

In FIG. 6, solenoid actuated blow valve 65 is normally open, while the solenoid actuated paint valve 66 is normally closed. Solenoid actuated jet air valve 76 is normally closed. Switch 90, when hit by the palm of the hand, is electrically connected to immediately actuate valve 76, and at the same time to energize time delay relay 100. The time delay relay 100 is set to extinguish light L2 a predetermined time after switch 90 has been manually activated. Switch 90 times out after a preset time which is greater than the time set for the time delay relay 100.

Switch 92 is connected to provide a source of current to the two parallel connected solenoid actuated valves 65 and 66. The switch 92, when hit with the palm of the open hand, immediately actuates the parallel connected solenoids of valves 65 and 66 to simultaneously move valve 65 to the closed position and valve 66 to the open position. After a preset time interval, switch 92 times out, thereby de-energizing the solenoids of valves 65 and 66, and causing the valves to revert to their normal or de-energized configuration.

In operation of the embodiment disclosed in FIG. 6, a source of air is made available at SA. Compressed air flows through regulator 96, into S2, and hence into chamber 70, thereby providing a fluidized bed 69. Regulator 94 provides source S1 for the blow valve 65. Valve 65 is normally open; and therefore, a flow occurs from 94, through 65, and into the member 20, thereby causing compressed air to flow through the pipe as soon as member 20 is manually affixed in a removable manner to the end thereof.

Valve 76 is normally closed; and accordingly, no flow occurs from regulator 98 into the member 22 until the solenoid thereof is energized. Therefore, with the apparatus 119 in the standby configuration of FIG. 6, member 20 will be held by a workman so that a flow of compressed air is forced to travel through the interior of the pipe while member 22, which is likewise held to the outlet end of the pipe by a workman, has no flow from valve 76; and therefore, compressed air from 20 is being forced to flow through member 22.

Switch 102 is moved to the closed position, thereby providing a source of current for the manually actuated time delay relay switches 90 and 92. The operator in charge of the apparatus glances at each workman located at 20 and 22, and the workmen acknowledge his look of inquiry and signify that they are ready to treat the spinning, preheated joint of pipe. The operator next hits switch 90 with the palm of his hand and immediately thereafter hits switch 92 with the palm of his hand, with perhaps 3/10 second expiring between actuation of the two switches.

Actuation of time delay switch 90 energizes time delay relay 100 and energizes the solenoid of normally closed valve 76 causing the valve to open and thereby establishing a suction at member 22. At the same time, the lamp L2 is illuminated as the time delay relay 100 commences to time out. Meanwhile, light L2 is telling the workmen that member 22 should be placed on the outlet end of the pipe immediately, if he has not already done so. Time delay relay 100 has been set to time out before relay 90 times out; therefore, light L2 remains illuminated until time delay relay 100 reaches the end of its time cycle.

Actuation of switch 92 energizes the solenoids of valves 65 and 66. This causes valve 65 to assume the closed position, thereby discontinuing flow from regulator 94 into member 20. Simultaneously, valve 66 is moved to the open position, permitting flow to occur from the bed 69, into the intake pipe 67, through the valve 66 and through the member 20 where the pocket 56 of entrained plastic particles is forced to flow into the pipe.

Timer 92 de-energizes the parallel connected solenoids of valves 65 and 66 approximately 1 second after switch 92 has been actuated. Timer 100 times out approximately 1.3 second after switch 92 has been actuated, thereby informing the operator at 22 to remove the member from the end of the pipe. Hence, timer 92 times out to close valve 66 and open valve 65 about 3/10 second before light L2 is extinguished.

Upon timer 92 timing out, valve 65 returns to the normally open position permitting flow to occur from regulator 94 into member 20, thereby pushing the pocket 56 of entrained plastic particles through the pipe. At this stage of the operation, no further flow occurs into standpipe 67 because valve 66 has assumed the normally closed position.

Light L2 preferably is extinguished in sufficient time to enable the workman to remove the venturi member from the outlet end of the pipe immediately before the remains of pocket 56 arrives at the outlet end of the pipe.

The operator continues to permit the pipe to spin for a few seconds in order to set the plastic lining and thereafter he stops the rotation of the spinning pipe, transfers the treated pipe joint to station 32 of FIG. 1, and immediately thereafter places a new heated pipe from 16 onto the spinning apparatus 58–60. The above described sequence of events is repeated in order to treat another joint of pipe.

The valves 65 and 76 can be an ordinary $\frac{3}{4}$ inch solenoid actuated control valve which has a relatively quick rate of response. The valve 66 is preferably a ball type valve which is pneumatically actuated by a double acting piston, by utilizing an air reversing solenoid valve made by Verser Valve Company. Line S1 is a $\frac{3}{4}$ inch diameter conduit. Intake pipe 67 is $1\frac{7}{8}$ inch id; conduit 64 is a 2 inch id; and conduit 47 is $\frac{3}{4}$ inch.

Example 1. A $2\frac{3}{8}$ inch tubing has been heated slightly above 400° F., the "power on" timer is set for one second, the "vacuum on" timer is set at six seconds, and the light signal L2 is set at 1.3 seconds. The "blow air" regulator is set at 34 psi, the vacuum regulator at 61 psi, and the fluid bed regulator at 15 ounces pressure so that the powder assumes a light rolling appearance.

The operational sequence occurs such that the vacuum and blow air come on, and thereafter the paint valve opens while the blow air valve closes. The red light subsequently indicates that the member 22 should be removed. The pipe is rotated for several additional seconds to set the coating, after which the pipe is removed and the ends painted manually so as to preserve the threads.

Example 2. A cleaned $2\frac{7}{8}$ inch tubing is preheated to 410° F. and rotated at a speed of 80 to 100 rpm. The blow pressure is set at 42 psi, the air source to create the vacuum at 63 psi, and the powder valve is set to remain open 1.2 seconds. The vacuum air valve is set to remain open 6.5 seconds. The signal to take off member 22 is set at 1.5 seconds.

Example 3. A $2\frac{3}{8}$ inch tubing has been cleaned and preheated to 410° F. and is spinning at 80 to 100 rpm. The blow air pressure is set at 34 psi, the vacuum jet air pressure at 61 psi, the powder valve is set to remain open for one second, the vacuum air valve is set for 6 seconds, and the "take off vacuum" light signals at the end of 1.3 seconds. The powder used in the above two examples is Corvel 501 powder which is available from The Polymer Company, Reading, Pennsylvania.

Example 4. M and T powder (M and T Chemicals, North Post Oak Road, Houston, Texas) is charged into the container at 69 and a $2\frac{7}{8}$ inch cleaned tubing, which has been heated to 375° F. is rotated at 80–100 rpm. The blow air pressure is set at 34 psi, the vacuum set at 62 psi, the powder valve is opened for one second, the vacuum air valve is open for 6 seconds, and the signal to remove the vacuum is set for 1.3 seconds.

In each of the above examples of the present invention, it is necessary for air to be blowing through the preheated pipe while the pipe is rotated at a suitable velocity to spread the melted plastic into a continuous uniform film about the interior thereof. The vacuum at 22 is always applied to the outlet end of the pipe prior to opening of the paint valve 66. The blow valve 65 is always closed simultaneously with the opening of the paint valve 66 so that there is substantially no interruption in the continuous flow through the pipe. This expedient takes advantage of the momentum of the mass flow of the material established by the blow valve 66 so as to augment the efforts of the vacuum at 22 in order to ingest the entrained plastic particles into the standpipe 67 and translocate the charge into the pipe as diagrammatically illustrated at 56 in FIG. 6. The size of the charge 56 is regulated by adjustment of the time delay interval of valve 66. Furthermore, it is essential that valve 65 open simultaneously with the closing of valve 66 so as to push the pocket 56 through the pipe and towards the vacuum source 22.

The vacuum source 22 is removed from the end of the pipe just before any plastic particles can emerge therefrom. The pocket of entrained plastic particles 56 becomes heated as it travels through the hot spinning pipe 11. Moreover, member 22 becomes heated because of the hot compressed air flowing therethrough. Should member 22 remain attached to the end of the spinning pipe, it rapidly becomes coated with plastic and its efficiency diminishes.

The surplus plastic 56 emerging from the end of the pipe can be received in any type open or closed container and accumulated for re-use, if desired. This is a matter of economics and housecleaning, and does not touch on the merits of the operation of the process.

The powder on valve 66 is a Jamesbury 2 inch ball valve, model C, which is actuated by a Versa solenoid, type A, #XB584383, 120v 60 cycles; which receives a pneumatic signal from a Jamesbury ST-20 and ST-50 air actuator.

The blow air valve 65 and the jet air valve 76 are manufactured by Automatic Smith Company, #649715, Catalog #8210A3 and includes a ¾ inch orifice therein.

The TDR 90 and 92 are Allen Bradley Pneumatic timing units described in Bulletin 1496, January, 1973, Allen Bradley Industrial Control Division, Milwaukee, Wisconsin, 53204.

Where deemed desirable, a prime coat of material can be applied to the interior of the pipe prior to the application of the plastic particles. For example, a prime coating of NAPKO, #77N144 (NAPKO Corporation of Houston, Texas) can be used to advantage in conjunction with the present invention.

I claim:

1. Method of coating the interior surface of a pipe with a plastic coating of substantially uniform thickness, comprising:

1. selecting a thermoplastic synthetic resin material in particulate form wherein the selected material is capable of being bonded to the interior pipe surface;
2. forming a fluidized bed of said thermoplastic material;
3. heating said pipe to be coated to a temperature above the softening temperature of said thermoplastic material;
4. applying air pressure to an inlet end of the heated pipe to cause a flow to occur therethrough;
5. applying a reduced pressure at the outlet end of said heated pipe;
6. flowing a pocket of thermoplastic material from said fluidized bed into said inlet end of said pipe while the interior surface of said pipe is above the softening temperature of the resin material by simultaneously discontinuing the application of said air pressure to said inlet end of said heated pipe and connecting said inlet end of the heated pipe to said fluidized bed while continuing to apply said reduced pressure;
7. re-applying said air pressure and simultaneously discontinuing said flow from said fluidized bed after a pocket of thermoplastic material has been transferred into said heated pipe, said pocket having a length which is less than the length of said heated pipe;
8. removing said reduced pressure from said heated pipe before said pocket of thermoplastic material reaches the end of said heated pipe;
9. said re-applying of said air pressure effecting an application of thermoplastic material in said pocket in substantially uniform thickness to the interior surface of said heated pipe along the full length of said heated pipe;
10. fusing the deposited thermoplastic material on the interior of the heated pipe at a pressure which is in excess of the ambient pressure;
11. spinning said pipe about its longitudinal axis during steps 6, 7, 8, 9, and 10 at a rotational velocity which causes any melted thermoplastic material applied to the interior wall of said pipe to spread out into a continuous smooth coating.

2. The method of claim 1 wherein said pipe of step 3 is preheated to a temperature of 400° F. and step 11 is carried out at 80 to 100 rpm.

3. The method of claim 1 wherein step 6–8 are carried out by connecting a source of air pressure and said fluidized bed in parallel to said inlet of said pipe, and controlling the flow into the inlet of the pipe such that an uninterrupted mass flow occurs wherein a pocket of entrained plastic particles moves through the pipe in series relationship respective to a flow of compressed air.

4. The method of coating the interior surface of an elongated, hollow member comprising the steps of:

forming a fluidized bed of particulated synthetic polymeric material;

heating the interior surface to be coated to a temperature above the softening temperature of said polymeric material;

rotating said hollow member about the longitudinal axis thereof at a rotational velocity which causes any of the polymeric material which subsequently adheres to the heated interior surface to form a uniform coating about the inner peripheral wall surface of said hollow member;

producing a pressure differential across the interior of said hollow member such that a flow of compressible fluid occurs therethrough;

connecting the inlet end of said hollow member to said fluidized bed while applying reduced pressure at the outlet end of said hollow member to cause a charge of the polymeric material to flow from said fluidized bed into said hollow member while at the same time the temperature is at a temperature which is above the softening temperature of the polymeric material, the hollow member is being rotated, and a negative pressure differential is maintained across said hollow member by said reduced pressure at said outlet of said hollow member;

interrupting said negative pressure differential after a pocket of said charge has been withdrawn from said fluidized bed by applying a positive pressure at said inlet of said hollow member while said pocket is in the act of flowing through said hollow member and before the length of said pocket exceeds the length of said hollow member for applying particles in said pocket in substantially uniform thickness to the interior surface of the rotating heated hollow member along substantially the full length of said hollow member;

fusing the deposited particles to the interior of the heated rotating hollow member at a pressure which is in excess of ambient pressure;

to thereby cause a charge of said polymeric material to flow from said fluidized bed and through the heated rotating hollow member, while a substantial portion of said polymeric material coats the interior of said hollow member.

5. The method of claim 4 wherein said hollow member is preheated to a temperature of 400° F., and the step of spinning is carried out at 80 to 100 rpm.

6. The method of claim 4 wherein the fluidized bed is flowed into said hollow member by connecting a source of air pressure and said fluidized bed in parallel relationship to said inlet of said hollow member, and controlling the flow into the inlet of the hollow member such that an uninterrupted mass flow occurs wherein a pocket of entrained plastic particles moves through the hollow member in series relationship respective to a flow of compressed air.

7. Method of coating the interior of a pipe with a substantially uniform coating of thermoplastic synthetic resin material comprising the steps of:

1. preheating said pipe to be coated to a temperature above the softening temperature of said resin material;
2. connecting an inlet end of the pipe to a fluidized bed of particulated resin material and to a source of compressed gas such that flow from either of said fluidized bed and said compressed gas can be selectively effected into said inlet end of said pipe;
3. selectively connecting the outlet end of the pipe to a source of atmospheric pressure and to a source of reduced pressure;
4. forcing compressed gas to flow into the inlet end of said pipe by connecting said source of reduced pressure to the outlet end of said pipe;
5. connecting said fluidized bed to said inlet end of the pipe so that a pocket comprised of a mass of gas-entrained said particulated resin material flows into said pipe;
6. discontinuing the flow from said fluidized bed after a pocket of resin material has been transferred into the connection leading to the inlet end of the pipe, while simultaneously establishing a flow of compressed gas into said inlet of the pipe; thereby contacting the pipe wall with the resin material in said pocket to form a substantially uniform thickness on the interior surface of said pipe along substantially the full length of the pipe; said pocket having a length less than the length of said pipe;
7. removing said source of reduced pressure from the outlet end of the pipe after the step of discontinuing the flow from said fluidized bed and before the pocket reaches the outlet end of the pipe;
8. fusing the resin material which contacts the pipe wall to the interior of the pipe at a pressure which is greater than the ambient pressure;
9. carrying out steps 5, 6, and 7 while the temperature of the pipe is above the softening temperature of the resin material and while the pipe is being rotated abouts its longitudinal axis at a rotational velocity which causes the resin material to form a uniform coating;
10. continuing to rotate said pipe until said resin material has been forced into a uniform coating.

8. The method of claim 7 wherein said pipe is preheated to a temperature of 400° F., and said pipe is rotated at 80 to 100 rpm.

9. The method of claim 7 wherein the plastic is transfered into the pipe by connecting a source of air pressure and said fluidized bed in parallel relationship to said inlet of said pipe, and controlling the flow into the inlet of the pipe such that an uninterrupted mass flow occurs wherein a pocket of entrained plastic particles moves through the pipe in series relationship respective to a flow of compressed air.

10. The method of claim 7 wherein compressed gas is flowed into said pipe for a first interval of time, flow from said fluidized bed occurs for a second interval of time, and the second flow of compressed gas occurs for a third interval of time;

said second interval of time being of a sufficient duration to ingest a pocket of plastic into said pipe which is in excess of the amount of plastic required for forming said coating.

11. The method of claim 10 wherein said pipe is preheated to a temperature of 400° F., and said pipe is rotated at 80 to 100 rpm.

12. The method of claim 10 wherein the plastic is transfered into the pipe by connecting a source of air pressure and said fluidized bed in parallel relationship to said inlet of said pipe, and controlling the flow into the inlet of the pipe such that an uninterrupted mass flow occurs wherein a pocket of entrained plastic particles moves through the pipe in series relationship respective to a flow of compressed air.

13. A method of coating the interior of a pipe with a substantially uniform layer of thermoplastic synthetic resin material comprising the steps of:

1. preheating the pipe to be coated to an elevated temperature which is above the softening temperature of said resin material;
2. connecting an inlet end of the pipe to a fluidized bed of particulated synthetic resin material and to a source of compressed gas such that flow from either of said fluidized bed or said compressed gas can be selectively effected into said inlet end of said pipe;
3. alternately connecting the outlet end of said pipe to a source of reduced pressure and atmospheric pressure such that flow from said pipe to either of said reduced pressure source and said atmospheric pressure can be selected;
4. connecting said fluidized bed to said inlet end of said pipe and connecting said source of reduced pressure to said outlet end of said pipe so that a pocket comprised of a mass of gas-entrained, resin material flows into said pipe;
5. discontinuing the flow from said fluidized bed before the length of said pocket exceeds the length of said pipe and substantially simultaneously applying said source of compressed gas to said inlet end of said pipe to thereby push the pocket of resin material from said inlet towards said outlet of said pipe;
6. removing said source of reduced pressure from the outlet end of the pipe after the step of discontinuing the flow from said fluidized bed and before the pocket reaches the outlet end of the pipe;
7. fusing the resin material in a substantially uniform thickness layer to substantially the full length of the interior of the pipe at a pressure in excess of atmospheric; and, 8. carrying out steps 4, 5, and 6 while the pipe is heated above the softening temperature of the resin material and while rotating said pipe about its longitudinal axis centerline at a rotational velocity to cause the fused plastic particles to be distributed in a uniform thickness throughout substantially the full length of the pipe.

* * * * *

UNITED STATES PATENT OFFICE

CERTIFICATE OF CORRECTION

Patent No. 4,089,998 Dated May 16, 1978

Inventor(s) JACK E. GIBSON

It is certified that error appears in the above-identified patent and that said Letters Patent are hereby corrected as shown below:

Column 8, line 16, delete "a";
Line 18, substitute --powder-- for "power";
Column 10, line 24, substitute --steps-- for "step";
Line 53, substitute --member-- for "temperature", first occurrence;
Column 11, line 64, substitute --about-- for "abouts";
Column 13, line 4, substitute --axial-- for "axis".

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*